US008770729B2

(12) United States Patent
Enomoto

(10) Patent No.: US 8,770,729 B2
(45) Date of Patent: Jul. 8, 2014

(54) IMAGE FORMING APPARATUS MOUNTING REPLACEABLE LIQUID CARTRIDGE

(71) Applicant: Tadayasu Enomoto, Kanagawa (JP)

(72) Inventor: Tadayasu Enomoto, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 52 days.

(21) Appl. No.: 13/684,846

(22) Filed: Nov. 26, 2012

(65) Prior Publication Data

US 2013/0147883 A1 Jun. 13, 2013

(30) Foreign Application Priority Data

Dec. 13, 2011 (JP) ..... 2011-272772

(51) Int. Cl.
*B41J 2/175* (2006.01)

(52) U.S. Cl.
CPC ..... *B41J 2/175* (2013.01); *B41J 2/1752* (2013.01)
USPC ..... 347/86

(58) Field of Classification Search
USPC ..... 347/85, 86
See application file for complete search history.

(56) References Cited

U.S. PATENT DOCUMENTS

| | | | | |
|---|---|---|---|---|
| 5,242,702 | A * | 9/1993 | Fond | 426/433 |
| 5,245,361 | A * | 9/1993 | Kashimura et al. | 347/50 |
| 5,448,274 | A * | 9/1995 | Hirabayashi et al. | 347/86 |
| 5,506,611 | A * | 4/1996 | Ujita et al. | 347/86 |
| 5,534,899 | A * | 7/1996 | Uchikata et al. | 347/49 |
| 6,422,693 | B2 * | 7/2002 | Pawlowski et al. | 347/86 |
| 7,922,398 | B2 * | 4/2011 | Nozawa et al. | 385/86 |
| 2007/0222839 | A1 * | 9/2007 | Sasaki et al. | 347/86 |

FOREIGN PATENT DOCUMENTS

| | | |
|---|---|---|
| JP | 2006-44236 | 2/2006 |
| JP | 2010-234801 | 10/2010 |

* cited by examiner

*Primary Examiner* — Huan Tran
(74) *Attorney, Agent, or Firm* — Cooper & Dunham LLP

(57) ABSTRACT

An image forming apparatus includes a recording head, a liquid cartridge, a cartridge holder, a hook member, and an engagement portion. The recording head ejects liquid droplets. The liquid cartridge stores liquid to be supplied to the recording head. The cartridge holder replaceably mounts the liquid cartridge. The hook member is integrally formed with an inner wall face of the cartridge holder to engage the liquid cartridge when the liquid cartridge is mounted in the cartridge holder. The engagement portion is provided at an outer wall face of the liquid cartridge to engage the hook member.

6 Claims, 11 Drawing Sheets

IMAGE FORMING APPARATUS MOUNTING REPLACEABLE LIQUID CARTRIDGE

CROSS-REFERENCE TO RELATED APPLICATIONS

This patent application is based on and claims priority pursuant to 35 U.S.C. §119 to Japanese Patent Application No. 2011-272772, filed on Dec. 13, 2011, in the Japan Patent Office, the entire disclosure of which is hereby incorporated by reference herein.

BACKGROUND

1. Technical Field

This disclosure relates to an image forming apparatus, and more specifically to an image forming apparatus mounting replaceable liquid cartridges.

2. Description of the Related Art

Image forming apparatuses are used as printers, facsimile machines, copiers, plotters, or multi-functional devices having two or more of the foregoing capabilities. As one type of image forming apparatus employing a liquid-ejection recording method, an inkjet recording apparatus is known that uses a recording head (liquid ejection head or liquid-droplet ejection head) for ejecting droplets of ink or other liquid.

Such a liquid-ejection-type image forming apparatus may have a liquid cartridge (container) replaceably mounted in a cartridge holder (tank holder). For example, JP-2006-044236-A proposes to provide a lock arm body having an engagement hook to hold an ink cartridge mounted on a cartridge holder so that the ink cartridge accidentally detaches from the cartridge holder. An urging member formed of a spring elastic body engages the lock arm body to urge the engagement hook of the lock arm body, thus engaging the engagement hook with the ink cartridge mounted on the cartridge holder.

However, for the configuration described in JP-2006-044236-A, as described above, the urging member formed of the spring elastic body engages the lock arm body, thus hampering cost reduction.

BRIEF SUMMARY

In an aspect of this disclosure, there is provided an image forming apparatus including a recording head, a liquid cartridge, a cartridge holder, a hook member, and an engagement portion. The recording head ejects liquid droplets. The liquid cartridge stores liquid to be supplied to the recording head. The cartridge holder replaceably mounts the liquid cartridge. The hook member is integrally formed with an inner wall face of the cartridge holder to engage the liquid cartridge when the liquid cartridge is mounted in the cartridge holder. The engagement portion is provided at an outer wall face of the liquid cartridge to engage the hook member.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
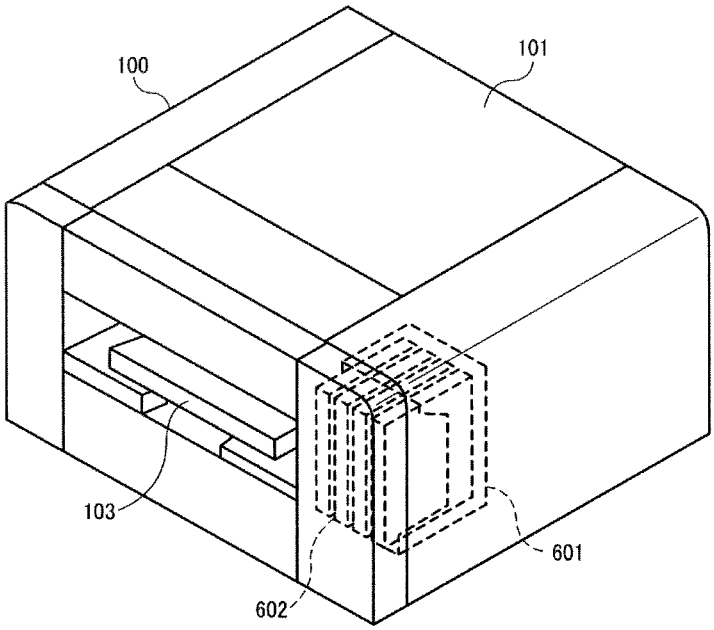
FIG. 1 is an external perspective view of an image forming apparatus according to an exemplary embodiment of the present disclosure.

The accompanying drawings are intended to depict exemplary embodiments of the present disclosure and should not be interpreted to limit the scope thereof. The accompanying drawings are not to be considered as drawn to scale unless explicitly noted.

DETAILED DESCRIPTION OF EXEMPLARY EMBODIMENTS

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

For example, in this disclosure, the term "sheet" used herein is not limited to a sheet of paper and includes anything such as OHP (overhead projector) sheet, cloth sheet, glass sheet, or substrate on which ink or other liquid droplets can be attached. In other words, the term "sheet" is used as a generic term including a recording medium, a recorded medium, a recording sheet, and a recording sheet of paper. The terms "image formation", "recording", "printing", "image recording" and "image printing" are used herein as synonyms for one another.

The term "image forming apparatus" refers to an apparatus that ejects liquid on a medium to form an image on the medium. The medium is made of, for example, paper, string, fiber, cloth, leather, metal, plastic, glass, timber, and ceramic. The term "image formation" includes providing not only meaningful images such as characters and figures but meaningless images such as patterns to the medium (in other words, the term "image formation" also includes only causing liquid droplets to land on the medium).

The term "ink" is not limited to "ink" in a narrow sense, unless specified, but is used as a generic term for any types of liquid useable as targets of image formation. For example, the term "ink" includes recording liquid, fixing solution, DNA sample, resist, pattern material, resin, and so on.

The term "image" used herein is not limited to a two-dimensional image and includes, for example, an image applied to a three dimensional object and a three dimensional object itself formed as a three-dimensionally molded image.

Although the exemplary embodiments are described with technical limitations with reference to the attached drawings, such description is not intended to limit the scope of the invention and all of the components or elements described in the exemplary embodiments of this disclosure are not necessarily indispensable to the present invention.

Referring now to the drawings, wherein like reference numerals designate identical or corresponding parts throughout the several views, exemplary embodiments of the present disclosure are described below.

First, an image forming apparatus according to an exemplary embodiment of this disclosure is described with reference to FIGS. 1 to 4.

Figure 2:
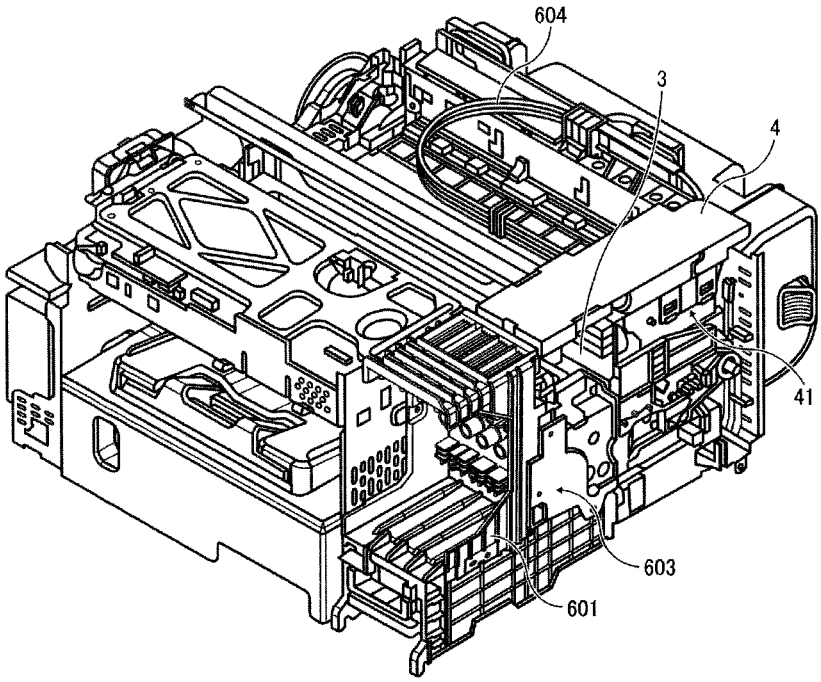
FIG. 2 is a perspective view of a mechanical section of the image forming apparatus of FIG. 1.
Figure 3:
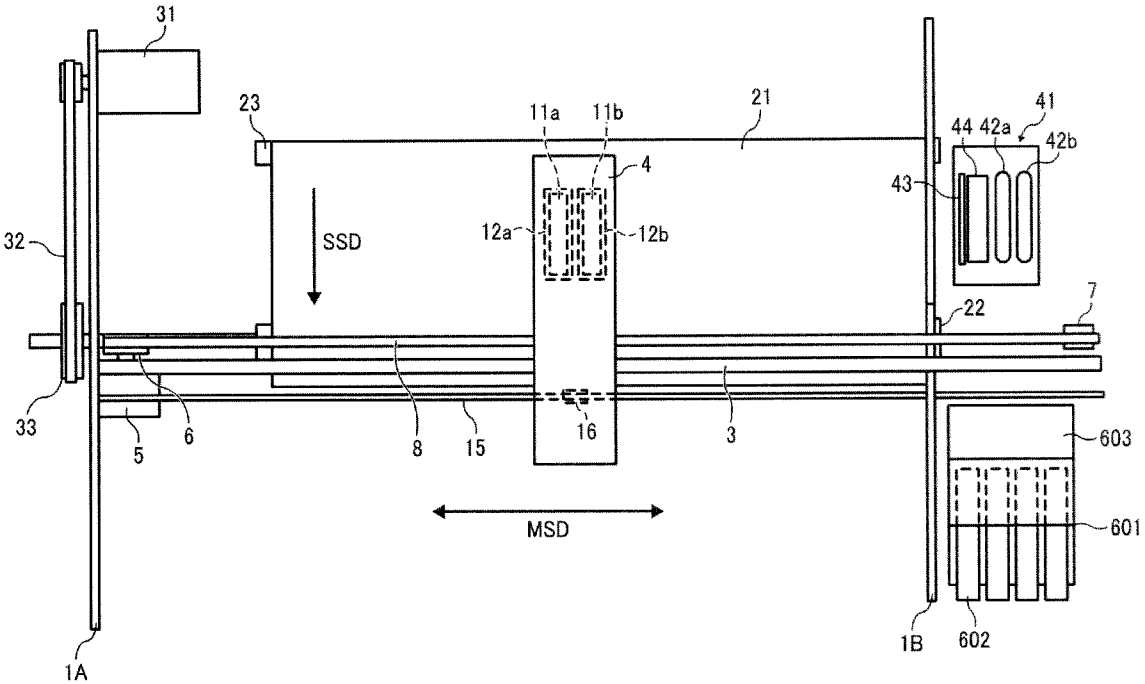
FIG. 3 is a partial plan view of the mechanical section of FIG. 2.
Figure 4:
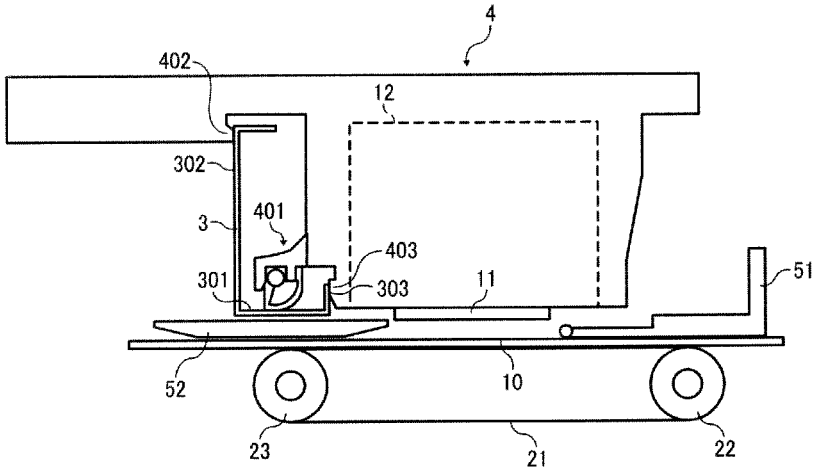
FIG. 4 is a side view of a carriage and its surrounding part of the image forming apparatus of FIG. 1.

FIG. 1 is an external perspective view of the image forming apparatus according to an exemplary embodiment of this disclosure. FIG. 2 is a perspective view of a mechanical section of the image forming apparatus of FIG. 1, FIG. 3 is a partial plan view of the mechanical section of FIG. 2. FIG. 4 is a side view of a carriage section of the image forming apparatus of FIG. 1.

In this exemplary embodiment, the image forming apparatus is a serial-type image forming apparatus and has an openable cover 101 at an upper face side of an apparatus body 100. By opening the cover 101, an operator can access the mechanical section inside the apparatus body 100.

As illustrated in FIGS. 2 and 3, the mechanical section includes a main left side plate 1A, a main right side plate 1B, a guide member 3, a carriage 4, a main scanning motor 5, a driving pulley 6, a driven pulley 7, and a timing belt 8. The guide member 3 is a plate member extending between the main side plates 1A and 1B to support the carriage 4. The carriage 4 is supported by the guide member 3 so as to be movable in a main scanning direction indicated by an arrow MSD in FIG. 3. The main scanning motor 5 moves the carriage 4 for scanning in the main scanning direction MSD via the timing belt 8 tensely extending between the driving pulley 6 and the driven pulley 7.

As illustrated in FIG. 4, the guide member 3 to guide movement of the carriage 4 is a plate member having guide faces 301, 302, and 303 serving as support faces to movably guide the carriage 4.

The carriage 4 is a so-called rodless type guide assembly having a height adjustment portion 401 movably supported by the guide face 301 of the guide member 3, a contact portion 402 to movably contact the guide face 302, and a contact portion 403 to movably contact the guide face 303.

The carriage 4 mounts recording heads 11*a* and 11*b* (collectively referred to as "recording heads 11" unless distinguished) formed with liquid ejection heads serving as image forming devices for ejecting ink droplets of different colors, e.g., yellow (Y), cyan (C), magenta (M), and black (K). The recording heads 11*a* and 11*b* are mounted on the carriage 4 so that nozzle rows, each of which includes multiple nozzles, are arranged in parallel to a direction (sub scanning direction indicated by an arrow SSD in FIG. 3) perpendicular to the main scanning direction and ink droplets are ejected downward from the nozzles.

Each of the recording heads 11*a* and 11*b* has two nozzle rows, and the four nozzle rows of the recording heads 11 are allocated to eject ink droplets of four colors Y, M, C, and K, respectively.

Head tanks 12*a* and 12*b* (collectively referred to as "head tanks 12" unless distinguished) are integrally provided with the recording heads 11*a* and 11*b* to supply ink to the recording heads 11*a* and 11*b*. On the apparatus body 100, liquid cartridges (hereinafter "ink cartridges" or "main tanks") 602 are replaceably mounted in a cartridge holder 601, and ink (liquid) is supplied by a liquid feed pump unit 603 from the ink cartridges 602 to the head tanks 12 via supply tubes 604.

An encoder scale 15 is disposed along the main scanning direction of the carriage 4. The carriage 4 mounts an encoder sensor 16 serving as a transmissive photosensor to read a scale (scale index serving as position identifier) of the encoder scale 15. The encoder scale 15 and the encoder sensor 16 form a linear encoder serving as a position detector to detect the position and speed of the carriage 4.

Below the carriage 4 is disposed a conveyance belt 21 serving as a conveyance device to convey a sheet 10 in the sub scanning direction SSD. The conveyance belt 21 is an endless belt looped around a conveyance roller 22 and a tension roller 23. The conveyance roller 22 is rotated by a sub-scanning motor 31 via a timing belt 32 and a timing pulley 33. The rotation of the conveyance roller 22 causes the conveyance belt 21 to circulate in the sub-scanning direction SSD.

As illustrated in FIG. 4, sheet guide members 51 and 52 are disposed at entry and exit portions of the conveyance belt 21.

At one end in the main scanning direction MSD of the carriage 4, a maintenance device (maintenance unit) 41 is disposed near a lateral side of the conveyance belt 21 to maintain and recover nozzle conditions of the recording heads 11. The maintenance device 41 includes, for example, a suction cap 42*a*, a moisture-retention cap 42*b*, a wiping member 43, and a dummy ejection receptacle 44. The suction cap 42*a* and the moisture-retention cap 42*b* cap nozzle faces (i.e., faces in which nozzle are formed) of the recording heads 11. The wiping member 43 wipes the nozzle faces of recording heads 11. The dummy ejection receptacle 44 receives droplets ejected by dummy ejection in which liquid droplets not contributing image formation are ejected. The suction cap 42*a* is connected to a suction pump serving as a suction device.

As illustrated in FIG. 1, the image forming apparatus further includes a sheet feed-and-output tray 103 removably mounted in the apparatus body 100. The sheet feed-and-output tray 103 serves as, e.g., both a sheet feeding device to feed a sheet 10 to the conveyance belt 21 and a sheet output device to output the sheet 10 having an image formed with ink droplets ejected from the recording heads 11.

While moving the carriage 4 in the main scanning direction, the image forming apparatus drives the recording heads 11 in response to image signals to eject ink droplets onto a sheet 10 conveyed intermittently by the conveyance belt 21. After a first line of a desired image is recorded on the sheet 10, the sheet 10 is conveyed at a certain distance by the conveyance belt 21. Then, another line of the image is recorded on the sheet 10 and the sheet 10 is conveyed at the certain distance. Such operation is repeated to form the full image and then the sheet 10 with the full image is output to the sheet feed-and-output tray 103.

To maintain and recover the nozzle conditions of the recording heads 11, the carriage 4 is moved to a home position at which the carriage 4 opposes the maintenance device 41. Then, maintenance-and-recovery operation, e.g., nozzle sucking operation for sucking ink from nozzles with the nozzle face of any of the recording heads 11 capped with the suction cap 42*a* or dummy ejection for ejecting ink droplets not contributed to image formation into the suction cap 42*a* or the dummy ejection receptacle 44, is performed, thus allowing image formation with stable droplet ejection.

Next, a mounting structure of the ink cartridges in the image forming apparatus this exemplary embodiment is described with reference to FIGS. 5 to 10.

Figure 5:
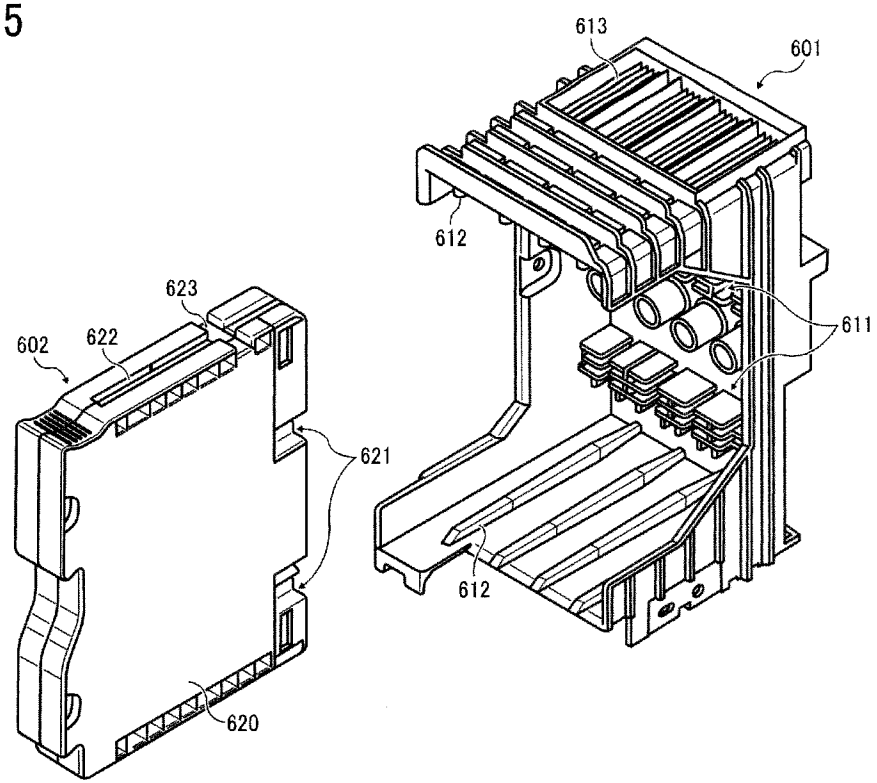
FIG. 5 is a perspective view of an ink cartridge and a cartridge holder in a state in which the ink cartridge is not mounted in the cartridge holder.
Figure 6:
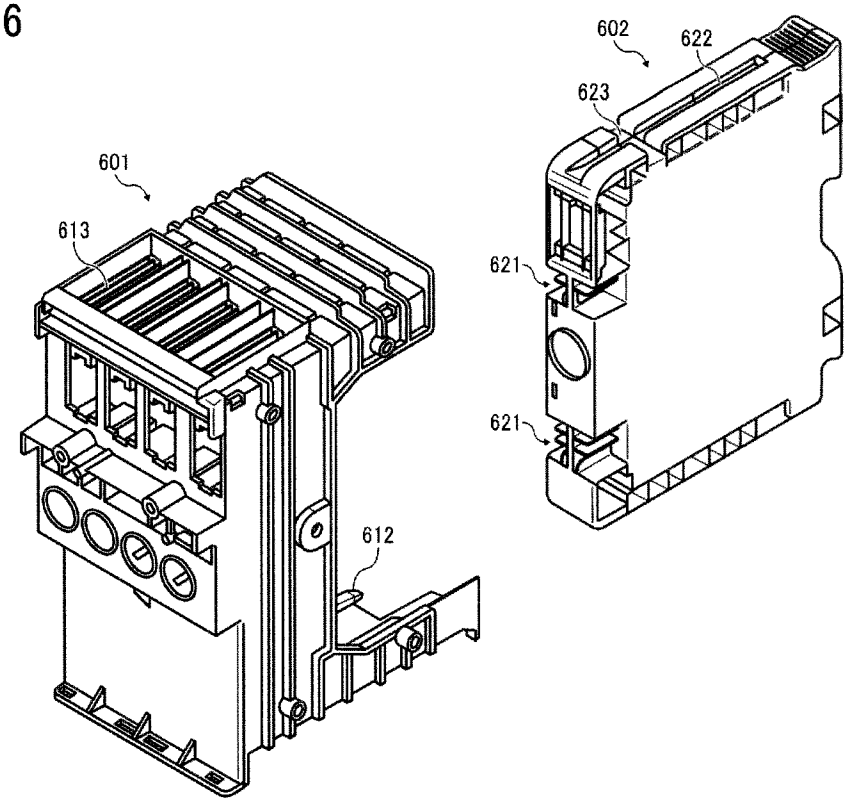
FIG. 6 is a perspective view of the ink cartridge and the cartridge holder seen from the opposite side of FIG. 5.
Figure 7A:
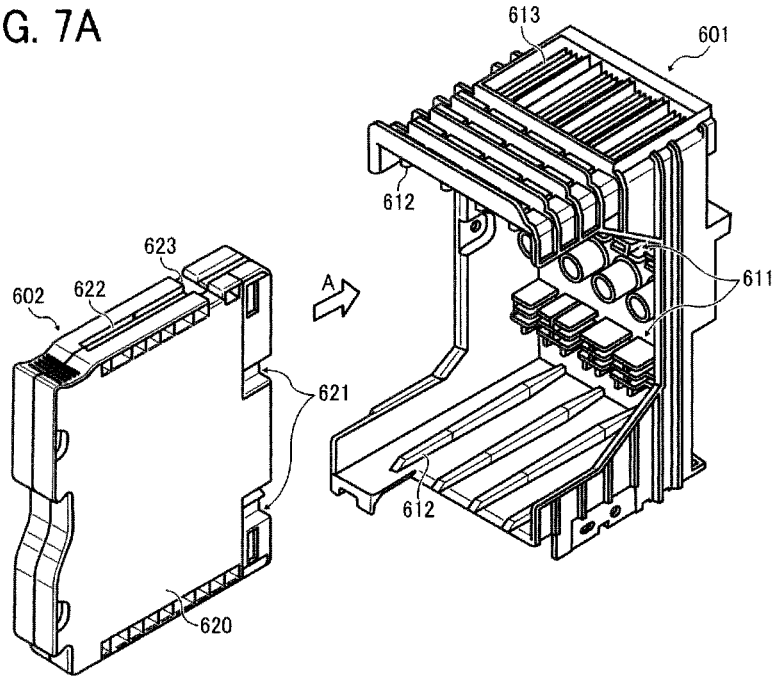
FIG. 7A is a perspective view of the ink cartridge and the cartridge holder in a state before the ink cartridge is installed to the cartridge holder.
Figure 7B:
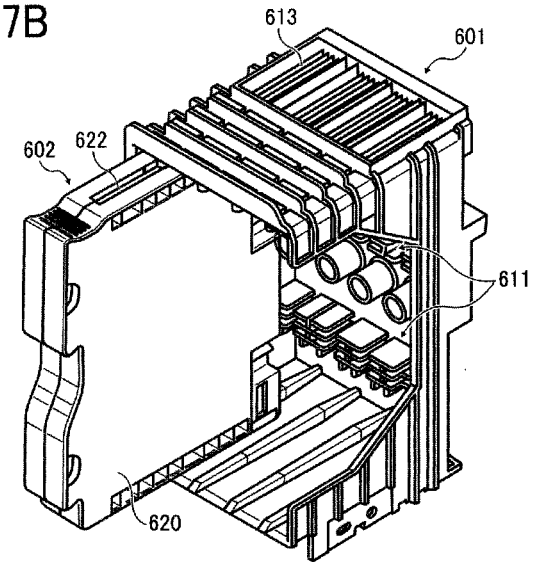
FIG. 7B is a perspective view of the ink cartridge and the cartridge holder in a state after the ink cartridge is installed to the cartridge holder.
Figure 8:
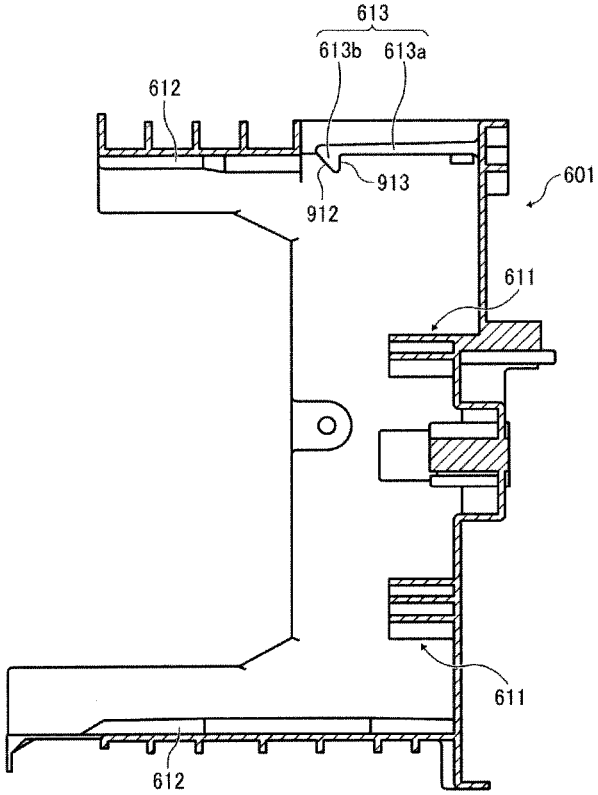
FIG. 8 is a cross-sectional side view of the cartridge holder.
Figure 9:
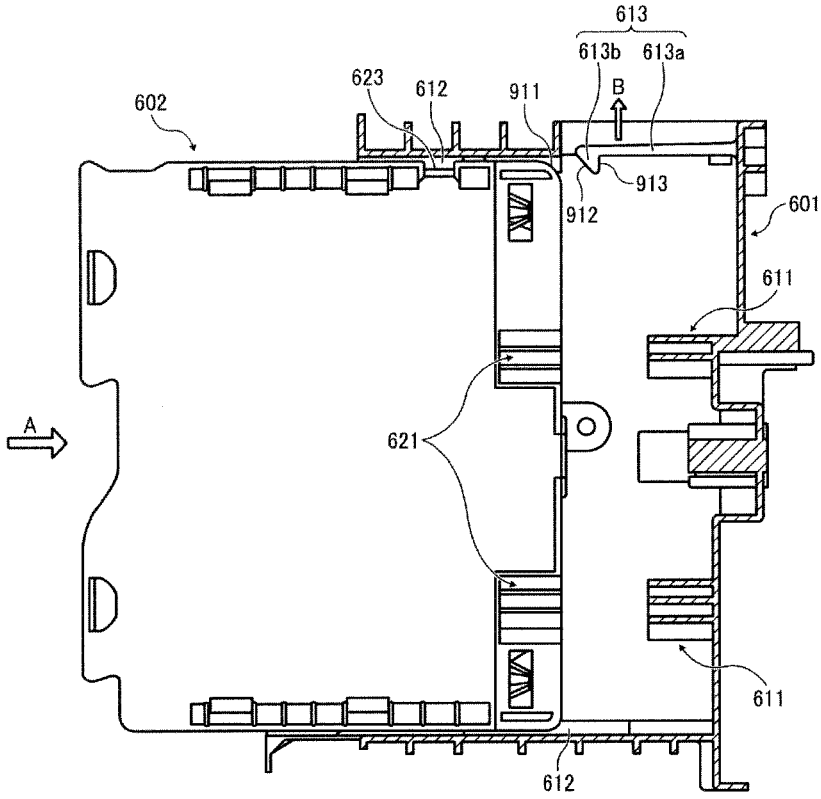
FIG. 9 is a cross-sectional side view of the ink cartridge and the cartridge holder in a state during which the ink cartridge is installed to the cartridge holder.
Figure 10:
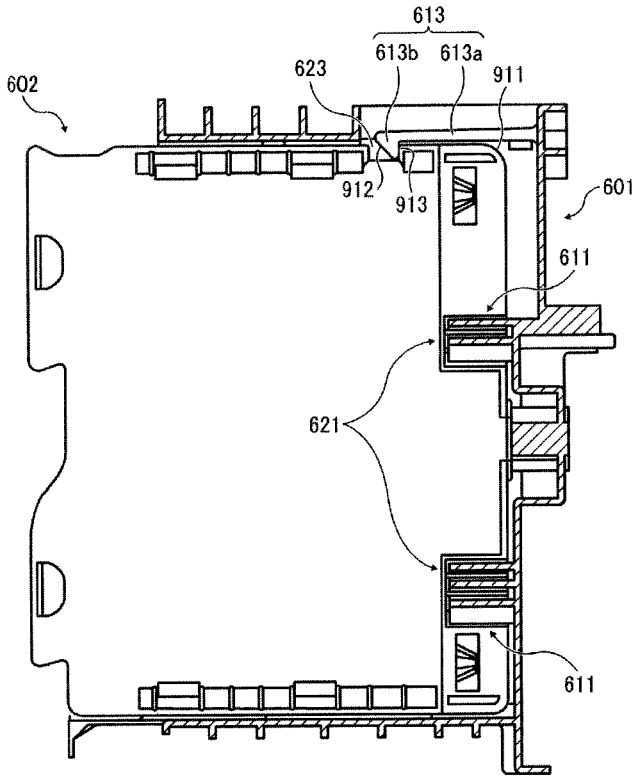
FIG. 10 is a cross-sectional side view of the ink cartridge and the cartridge holder in a state after the ink cartridge is installed to the cartridge holder.

FIG. 5 is a perspective view of one of the ink cartridges and the cartridge holder in a state in which the ink cartridge is not mounted in the cartridge holder. FIG. 6 is a perspective view of the ink cartridge and the cartridge holder seen from the opposite side of FIG. 5. FIG. 7A is a perspective view of the ink cartridge and the cartridge holder in a state before the ink cartridge is installed to the cartridge holder. FIG. 7B is a perspective view of the ink cartridge and the cartridge holder in a state after the ink cartridge is installed to the cartridge holder. FIG. 8 is a cross-sectional side view of the cartridge holder. FIG. 9 is a cross-sectional side view of the ink cartridge and the cartridge holder at a state during which the ink cartridge is installed to the cartridge holder. FIG. 10 is a cross-sectional side view of the ink cartridge and the cartridge holder in a state after the ink cartridge is installed to the cartridge holder.

The ink cartridge 602 has a cartridge case 620 that houses an ink storage bag to store desired color ink. At outer wall faces of the cartridge case 620 are formed distinguishing ribs 621 to distinguish the types (e.g., colors of liquid stored therein) of the ink cartridge 602, guide grooves 622 to be guided by the cartridge holder 601 during mounting, and a recessed portion 623 serving as an engagement portion.

The distinguishing ribs 621 are provided at a face (referred to as "back face") of the ink cartridge 602 that opposes a rear wall face of the cartridge holder 601 when the cartridge case 620 is installed to the cartridge holder 601. The guide grooves 622 are provided at faces (referred to as "upper face" and "bottom face") of the ink cartridge 602 that oppose top and bottom sides of the cartridge holder 601 when the cartridge case 620 is installed to the cartridge holder 601. The recessed portion 623 is provided at the upper face of the cartridge case 620.

The cartridge holder 601 has distinguishing ribs 611 to engage the distinguishing ribs 621 of the ink cartridges 602, guide ribs 612 to engage the guide grooves 622 of the ink cartridges 602, and hook members 613 to engage the recessed portions 623 of the ink cartridges 602.

The engagement state of the distinguishing ribs 621 of each ink cartridge 602 with the distinguishing ribs 611 of the cartridge holder 601 differs from color to color so as to correspond to the color of ink to be stored in the ink cartridge 602. When the ink cartridge 602 for a predetermined color is properly mounted, the distinguishing ribs 621 of the ink cartridge 602 can engage the distinguishing ribs 611 for the predetermined color of the cartridge holder 601.

The guide grooves 622 of each ink cartridge 602 and the guide ribs 612 of the cartridge holder 601 are formed along an insertion/removal direction of the ink cartridge 602 in which the ink cartridge 602 is inserted into or removed from the cartridge holder 601.

The hook members 613 are integrally formed with the cartridge holder 601 and each have an elastic deforming portion 613*a* and a claw portion 613*b* (see FIG. 8). The elastic deforming portion 613*a* is elastically deformable and has one end (referred to as "rear end") integrally formed with an inner wall face of the cartridge holder 601. The claw portion 613*b* is integrally formed with the opposite end (referred to as "front end") of the elastic deforming portion 613*a* to engage the recessed portion 623 of each ink cartridge 602.

As illustrated in FIG. 8, the claw portion 613*b* of each hook member 613 of the cartridge holder 601 has a slant face 912 at a side (front end side) at which the claw portion 613*b* opposes the cartridge case 620 when the ink cartridge 602 is installed to the cartridge holder 601. Similarly, the cartridge case 620 of the ink cartridge 602 has a slant face 911 at a side (front end side) at which the cartridge case 620 opposes the slant face 912 of each hook member 613 of the cartridge holder 601.

The claw portion 613*b* of each hook member 613 of the cartridge holder 601 has another slant face 913 at a side opposite to the slant face 912 in the insertion/removal direction of the ink cartridge 602.

For such a configuration, in removal operation of the ink cartridge 602 from the cartridge holder 601, when the ink cartridge 602 is pulled, the hook member 613 is lifted up, thus allowing removal of the ink cartridge 602. When the ink cartridge 602 is mounted in the cartridge holder 601, the claw portion 613*b* of the hook member 613 securely engages the recessed portion 623, thus preventing the ink cartridge 602 from loosening in the cartridge holder 601.

Next, insertion and removal of the ink cartridge 602 relative to the cartridge holder 601 are described below.

The ink cartridge 602 is inserted from an open side of the cartridge holder 601 in a direction indicated by an arrow A illustrated in FIGS. 7A and 9. At this time, first, the guide grooves 622 of the ink cartridge 602 engage the corresponding guide ribs 612 of the cartridge holder 601. When the ink cartridge 602 is inserted, the guide ribs 612 guide the ink cartridge 602.

As described above, when the ink cartridge 602 is inserted to the cartridge holder 601, the guide ribs 612 contact and rub against the guide grooves 622. As a result, contact portions of the ink cartridge 602 with the cartridge holder 601 might be damaged.

However, in this exemplary embodiment, since the guide grooves 622 are provided at the ink cartridge 602 and the guide ribs 612 are provided at the cartridge holder 601, only the inside of the guide grooves 622 of the ink cartridge 602, which users cannot easily see, is damaged. Such a configuration makes the damage of the ink cartridge 602 due to insertion/removal operation unnoticeable, thus maintaining the reusability of the ink cartridge 602.

Next, when the ink cartridge 602 contacts the hook member 613 integrally formed with the cartridge holder 601, the slant face 911 on the front end side of the ink cartridge 602 contacts the slant face 912 on the front end side of the hook member 613 of the cartridge holder 601. In this state, when the ink cartridge 602 is further pushed into the cartridge holder 601, the elastic deforming portion 613*a* of the hook members 613 deforms and the claw portion 613*b* is lifted up in a direction indicated by an arrow B in FIG. 9.

When the ink cartridge 602 is further pushed into the cartridge holder 601 with the hook member 613 lifted up, the hook member 613 urges the ink cartridge 602 from above in a direction in which the restoring force of the elastic deforming portion 613*a* returns the hook member 613 to an original position, thus stabilizing the position of the ink cartridge 602 during insertion.

In this exemplary embodiment, the front end side of the ink cartridge 602 and the front end side of the claw portion 613*b* of the hook member 613 have the slant faces 911 and 912, respectively, to minimize the setting force in the insertion of the ink cartridge 602. However, it is to be noted that the configuration for lifting the hook member 613 to urge the ink cartridge 602 is not limited to the above-described shape but may be any other suitable shape.

When the ink cartridge 602 is further inserted toward the cartridge holder 601, the ink cartridge 602 arrives at the position of the distinguishing ribs 611 of the cartridge holder 601 that distinguish the type of the ink cartridge 602. The distinguishing ribs 611 are formed of a plurality of ribs having certain patterns, and the distinguishing ribs 621 are also provided at the ink cartridge 602 so as to have patterns corresponding to and engageable with the patterns of the distinguishing ribs 611.

When a correct type of the ink cartridge 602 is inserted, the patterns of the distinguishing ribs 621 can pass (engage) the patterns of the distinguishing ribs 611 without conflicting the patterns of the distinguishing ribs 611. By contrast, when an incorrect type of the ink cartridge 602 is inserted, the patterns of the distinguishing ribs 621 physically conflict the patterns of the distinguishing ribs 611, thus preventing further insertion of the ink cartridge 602. In this exemplary embodiment, a distinguishing unit to distinguish the type of the ink cartridge is formed of ribs. However, it is to be noted that the distinguishing unit is not limited to the ribs but may be any other suitable members.

When a correct type of the ink cartridge 602 is inserted, a supply member, e.g., a needle of the cartridge holder 601 to form a channel to communicate with ink stored in the ink cartridge 602 is inserted.

When the ink cartridge 602 is inserted to a predetermined position, the hook member 613 of the cartridge holder 601 lifted as described above moves downward and engages the corresponding recessed portion 623 of the ink cartridge 602, thus preventing accidental removal of the ink cartridge 602.

In this exemplary embodiment, the guidance of the ink cartridge 602 by the guide ribs 612 and the guide grooves 622, the urging of the ink cartridge 602 by the hook member 613, the distinguishment of the type of the ink cartridge 602 by the non-interchangeable ribs (distinguishing ribs 611 and 612), the insertion of the supply member of the cartridge holder 601 to the ink cartridge 602, and the locking of the ink cartridge 602 by the hook member 613 function in this order.

In other words, before the supply member of the cartridge holder 601 is inserted to the ink cartridge 602, the hook member 613 urges the ink cartridge 602, thus allowing insertion of the supply member to the ink cartridge 602 at an appropriate position.

In addition, before the insertion of the supply member to the ink cartridge 602, the non-interchangeable ribs distinguish the type of the ink cartridge 602. Such a configuration prevents mis-insertion of the supply member to a different type of the ink cartridge 602, thus preventing mixture of different types of ink in the supply member or the ink cartridge 602.

It is to be noted that the function order is not limited to the above-described order in this exemplary embodiment but may be any other suitable order.

As described above, the hook members 613 are integrally provided at the cartridge holder 601, thus allowing cost reduction.

To integrally provide the hook members 613 at the cartridge holder 601, the hook members 613 of the cartridge holder 601 can be produced by, e.g., insert molding.

For example, members, e.g., leaf springs of SUS (steel use stainless) may be inserted to and molded with the cartridge holder, thus enhancing the durability of the hook members and minimizing the number of assembling steps and production cost.

Alternatively, to integrally provide the hook members 613 at the cartridge holder 601, the hook members 613 and the cartridge holder 601 may be produced by integral molding of resin. Integral molding of resin can minimizes the number of components, the number of assembling steps, and production cost.

Figure 12:
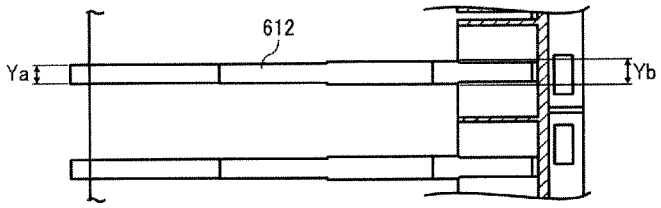
FIG. 12 is a schematic view of the cartridge holder seen from a direction indicated by an arrow Y of FIG. 11.
Figure 13:
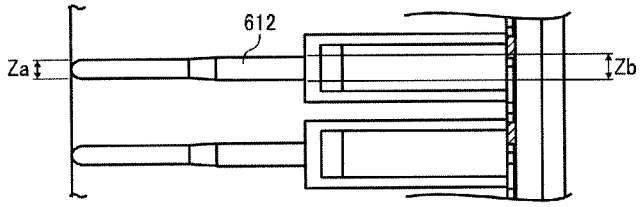
FIG. 13 is a schematic view of the cartridge holder seen from a direction indicated by an arrow Z of FIG. 11.

Next, another exemplary embodiment of this disclosure is described with reference to FIGS. 11 to 13.

Figure 11:
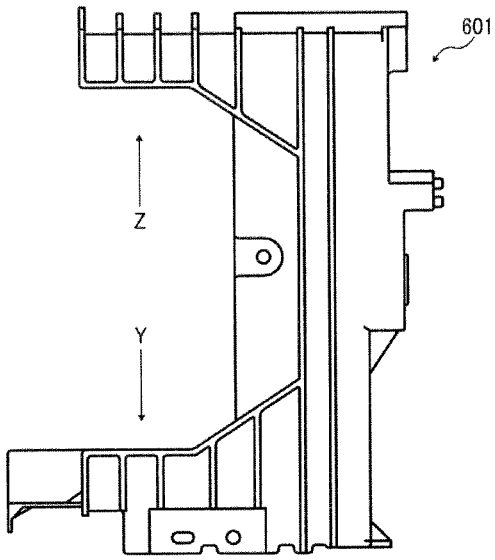
FIG. 11 is a side view of a cartridge holder in another exemplary embodiment of this disclosure.

FIG. 11 is a side view of a cartridge holder in another exemplary embodiment of this disclosure. FIG. 12 is a schematic view of the cartridge holder seen from a direction indicated by an arrow Y in FIG. 11. FIG. 13 is a schematic view of the cartridge holder seen from a direction indicated by an arrow Z in FIG. 11.

In this exemplary embodiment, each of guide ribs 612 of the cartridge holder 601 has different widths (i.e., lengths in an array direction in which the ink cartridges 602 are arranged side by side in the cartridge holder 601) in an insertion direction of the ink cartridge 602 to the cartridge holder 601. For example, as illustrated in FIG. 12, each of guide ribs 612 on a bottom side has a width Ya at a front end side and a width Yb at a setting position relative to the cartridge holder 601 ($Ya \leq Yb$). As illustrated in FIG. 13, each of guide ribs 612 on a top side has a width Za at a front end side and a width Zb at a setting position relative to the cartridge holder 601 ($Za \leq b$).

At the setting position, the guide grooves 622 of the ink cartridge 602 engage the corresponding guide ribs 612, thus defining the position of the ink cartridge 602 in the array direction.

Such a configuration simultaneously allows the guidance and positioning of the ink cartridge 602 and simplified shapes of the ink cartridge and the cartridge holder.

Numerous additional modifications and variations are possible in light of the above teachings. It is therefore to be understood that, within the scope of the appended claims, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. An image forming apparatus comprising:

a recording head to eject liquid droplets;

a liquid cartridge to store liquid to be supplied to the recording head;

a cartridge holder to replaceably mount the liquid cartridge, the cartridge holder having an opening serving as a cartridge insertion port, and the cartridge holder being box-shaped to include lateral side faces, upper and lower faces continuously and integrally molded with the lateral side faces, and a rear face continuously and integrally molded with the lateral side faces and the upper and lower faces and disposed at a rear side of the cartridge holder in a cartridge insertion direction in which the liquid cartridge is inserted into the cartridge holder, and the upper and lower faces each having a plurality of guide ribs disposed thereon to guide the liquid cartridge, the guide ribs of the upper face being formed at a front side of the cartridge holder in the cartridge insertion direction, the upper face further having a hook member formed by integral molding of a resin material at an inner wall face of the upper face, the hook member having a claw portion at a position more proximal to the rear side of the cartridge holder in the cartridge insertion direction than the guide ribs; and an engagement portion provided at an outer wall face of the liquid cartridge to engage the hook member, wherein the cartridge holder, the hook member, and the plurality of guide ribs are made of the same resin material and integrally formed by insert molding.

2. The image forming apparatus of claim 1, further comprising:

a guide groove provided at the liquid cartridge to engage any one of the guide ribs.

3. The image forming apparatus of claim 1, wherein the hook member further comprises an elastic deformation portion, the elastic deformation portion is elastically deformable and has a first end integrally formed with the inner wall face of the cartridge holder, and the claw portion is disposed at a second end opposite the first end of the elastic deformation portion to engage the engagement portion.

4. The image forming apparatus of claim 3, wherein the claw portion has a face to contact the engagement portion and the face is slanted relative to a direction in which the liquid cartridge is installed to the cartridge holder.

5. The image forming apparatus of claim 1, wherein a plurality of first outer ribs are disposed on the upper outer face of the hook member formed along the cartridge insertion direction, the plurality of first outer ribs are arranged side by side on the hook member and in a direction perpendicular to the cartridge insertion direction, and a plurality of second outer ribs are formed on an outer surface of the upper face at the front side of the cartridge holder, each of the outer ribs is formed along the direction perpendicular to the cartridge insertion direction.

6. The image forming apparatus of claim 1, wherein the hook member has one end fixed at the rear side of the cartridge holder in the cartridge insertion direction, and the claw portion of the hook member is disposed towards the front side of the cartridge holder in the cartridge insertion direction.

* * * * *